US005690076A

United States Patent [19]

Hashimoto et al.

[11] Patent Number: 5,690,076

[45] Date of Patent: Nov. 25, 1997

[54] EVAPORATIVE FUEL-PROCESSING SYSTEM FOR INTERNAL COMBUSTION ENGINES

[75] Inventors: Akira Hashimoto; Hideo Moriwaki; Yoshiaki Matsuzono; Sachito Fujimoto, all of Wako; Satoshi Kiso, Tochigi-ken, all of Japan

[73] Assignee: Honda Giken Kogyo Kabushiki Kaisha, Tokyo, Japan

[21] Appl. No.: 609,748

[22] Filed: Mar. 1, 1996

[30] Foreign Application Priority Data

Mar. 3, 1995 [JP] Japan ..... 7-070535

[51] Int. Cl.[6] ..... F02M 37/04

[52] U.S. Cl. ..... 123/520; 123/198 D

[58] Field of Search ..... 123/520, 521, 123/518, 519, 516, 198 D

[56] References Cited

U.S. PATENT DOCUMENTS

| | | | |
|---|---|---|---|
| 5,305,724 | 4/1994 | Chikamatsu | 123/198 D |
| 5,333,589 | 8/1994 | Otsuka | 123/520 |
| 5,355,864 | 10/1994 | Kuroda | 123/198 D |
| 5,396,873 | 3/1995 | Yamanaka | 123/520 |
| 5,427,075 | 6/1995 | Yamanaka | 123/520 |
| 5,448,980 | 9/1995 | Kawamura | 123/520 |
| 5,501,199 | 3/1996 | Yoneyama | 123/520 |
| 5,505,182 | 4/1996 | Denz | 123/520 |

FOREIGN PATENT DOCUMENTS

| | | | |
|---|---|---|---|
| 6-173789 | 6/1994 | Japan | 123/520 |

*Primary Examiner*—Carl S. Miller

*Attorney, Agent, or Firm*—Nikaido, Marmelstein, Murray & Oram LLP

[57] ABSTRACT

An evaporative fuel-processing system for an internal combustion engine has an evaporative emission control system. An ECU carries out negative pressurization of the interior of the evaporative emission control system, by opening a purge control valve and closing a vent shut valve, and determines presence/absence of leakage from the evaporative emission control system, based on a rate of decrease in negative pressure within the system, by closing a purge control valve. Before the negative pressurization, the interior of the evaporative emission control system is opened to the atmosphere, and during the open-to-atmosphere, a pressure state within the fuel tank is estimated based on a rate of change in an output from a pressure sensor which senses pressure within the evaporative emission control system. The ECU determines whether the evaporative emission control system is normal, based on the estimated pressure state.

8 Claims, 9 Drawing Sheets

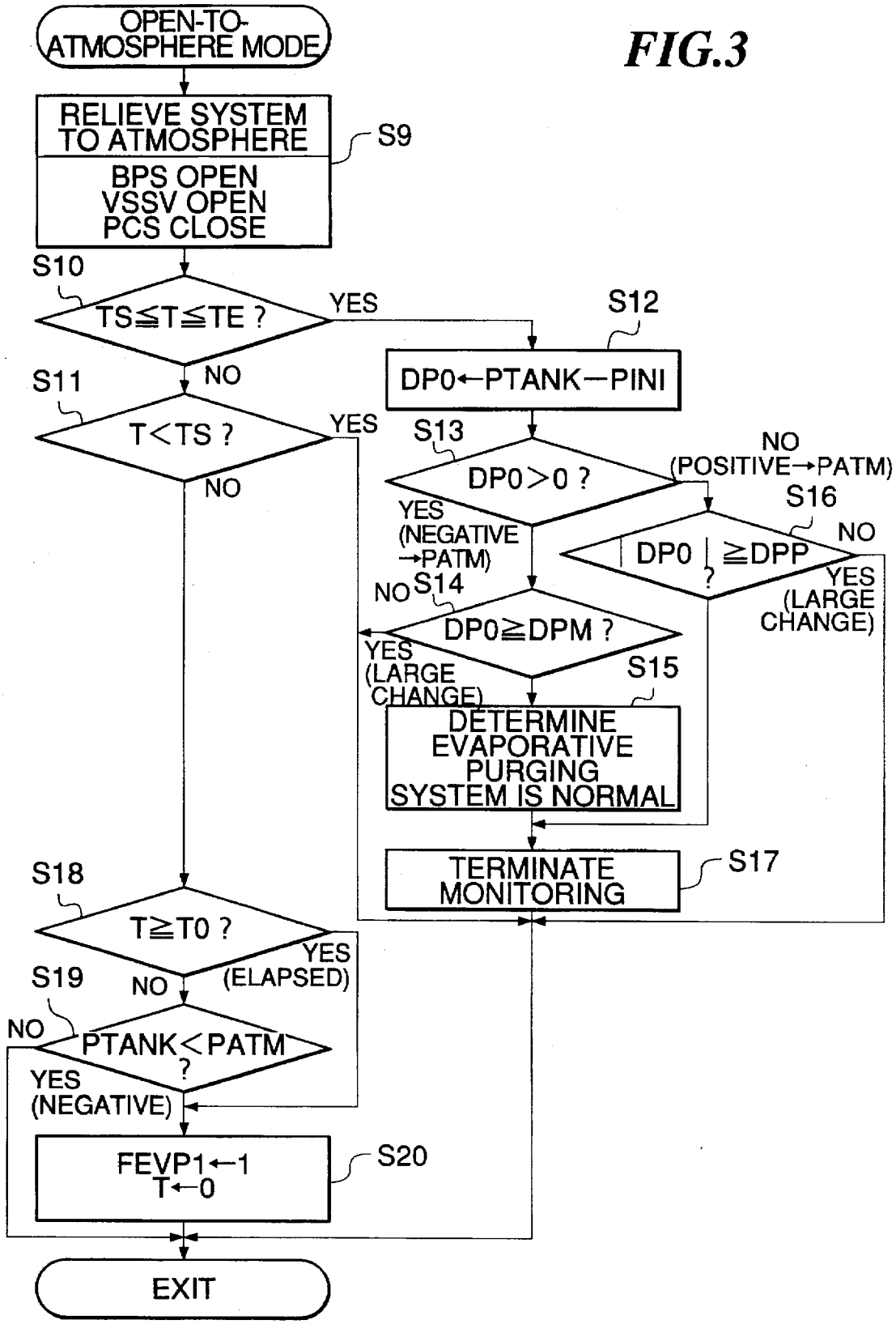
FIG.3
OPEN-TO-ATMOSPHERE MODE
RELIEVE SYSTEM TO ATMOSPHERE
BPS OPEN
VSSV OPEN
PCS CLOSE
S9
S10
TS≦T≦TE ?
YES
NO
S12
DP0←PTANK−PINI
S11
T<TS ?
YES
NO
S13
DP0>0 ?
NO (POSITIVE→PATM)
YES (NEGATIVE →PATM)
S16
|DP0| ≧DPP ?
NO
YES (LARGE CHANGE)
NO S14
DP0≧DPM ?
YES (LARGE CHANGE)
S15
DETERMINE EVAPORATIVE PURGING SYSTEM IS NORMAL
TERMINATE MONITORING
S17
S18
T≧T0 ?
YES (ELAPSED)
NO
S19
NO
PTANK<PATM ?
YES (NEGATIVE)
FEVP1←1
T←0
S20
EXIT LEAK-CHECKING MODE
S31
FEVP2=1 ?
NO
YES
S32
EXECUTE LEAK CHECKING
BPS CLOSE
VSSV CLOSE
PCS CLOSE
S33
T≧T21 ?
NO
YES
S34
P1←PTANK
S35
T≧T22 ?
NO
YES
S36
P2←PTANK
S37
T≧T23 ?
NO
YES
S38
P3←PTANK
S39
T≧T2 ?
NO
YES
S40
DP2←PTANK−P2
S41
FEVP2←0
FEVP3←1
T←0
EXIT

EVAPORATIVE FUEL-PROCESSING SYSTEM FOR INTERNAL COMBUSTION ENGINES

BACKGROUND OF THE INVENTION

1. Field of the Invention

This invention relates to an evaporative fuel-processing system for internal combustion engines, which purges evaporative fuel generated in the fuel tank into the intake system of the engine, and more particularly to an evaporative fuel-processing system of this kind, which has a function of determining whether or not a leak occurs in an evaporative emission control system which extends from the fuel tank to the intake system of the engine.

2. Prior Art

Conventionally, there are known abnormality-determining methods which determine whether a leak occurs in an evaporative emission control system of an internal combustion engine, which includes a canister for adsorbing evaporative fuel generated in the fuel tank, and a purging passage connecting between the canister and the intake system of the engine. These methods include a method which is known, e.g. from Japanese Laid-Open Patent Publication (Kokai) No. 6-173789, which carries out negative pressurization by introducing negative pressure within the intake system of the engine into the interior of the evaporative emission control system, and then seals the evaporative emission control system, followed by determining whether the evaporative emission control system undergoes leakage depending on the state of the negative pressure held within the evaporative emission control system (leak checking).

During the above-mentioned negative pressurization, the interior of the fuel tank is also negatively pressurized, so that evaporative fuel can be easily generated. As a result, it is required to purge a large amount of evaporative fuel generated in the fuel tank into the intake system of the engine after completion of the leak checking. Therefore, to maintain good exhaust emission characteristics of the engine, it is desirable to complete the abnormality determination as promptly as possible.

According to the method known, e.g. from Japanese Laid-Open Patent Publication (Kokai) No. 6-173789, however, a series of abnormality determinations have to be carried out. That is, it is essentially required to carry out the negative pressurization of the interior of the evaporative emission control system before a determination is carried out as to whether the evaporative emission control system is normal or abnormal, a judgment is rendered as to whether the determination as to abnormality of the system is to be suspended or reserved. This unfavorably requires a considerable time period. Therefore, the known method still remains to be improved to carry out a determination as to abnormality of the evaporative emission control system or make a judgment as to suspension of the abnormality determination as promptly as possible.

SUMMARY OF THE INVENTION

It is the object of the invention to provide an evaporative fuel-processing system for internal combustion engines, which is capable of carrying out the abnormality determination even before the evaporative emission control system is negatively pressurized, to thereby shorten a time period required for the abnormality determination.

To attain the above object, according to a first aspect of the invention, there is provided an evaporative fuel-processing system for an internal combustion engine having an intake system, and a fuel tank, comprising:

an evaporative emission control system including a canister having an adsorbent accommodated therein, for adsorbing evaporative fuel generated in the fuel tank, and an air inlet port communicating with atmosphere, a charging passage extending between the canister and the fuel tank, a purging passage extending between the canister and the intake system, a purge control valve arranged across the purging passage, and a vent shut valve for opening and closing the air inlet port of the canister;

pressure-detecting means for detecting pressure within the evaporative emission control system;

open-to-atmosphere means for relieving the interior of the evaporative emission control system to the atmosphere, by closing the purging valve and opening the vent shut valve;

tank state-detecting means for detecting a pressure state within the fuel tank, based on an output from the pressure-detecting means during operation of the open-to-atmosphere means; and determining means for determining whether the evaporative emission control system is normal, based on a result of the detection by the tank state-detecting means.

Preferably, the evaporative emission control system further includes a charging valve arranged across the charging passage, the open-to-atmosphere means opening the charging valve during the operation of the open-to-atmosphere means.

Also preferably, the determining means determines that the evaporative emission control system is normal, when the tank state-detecting means detects that pressure within the fuel tank was negative at the start of the operation of the open-to-atmosphere means and at the same time an amount of change in the pressure within the fuel tank after the start of the operation of the open-to-atmosphere means exceeds a predetermined value.

Advantageously, the evaporative fuel-processing system includes negatively pressurizing means for negatively pressurizing the interior of the evaporative emission control system into a predetermined negatively pressurized state, by opening the purge control valve and closing the vent shut valve; and leakage-checking means for closing the purge control valve after the interior of the evaporative emission control system is brought into the predetermined negatively pressurized state, and for determining whether there is leakage from the evaporative emission control system, based on a rate of decrease in negative pressure within the evaporative emission control system after the closing of the purge control valve; and wherein the negatively pressurizing means is operated when the determining means does not determine that the evaporative emission control system is normal.

Preferably, the tank state-detecting means calculates the amount of change in the pressure within the fuel tank after the start of operation of the open-to-atmosphere means, within a predetermined time period after a first predetermined time period elapses from the start of the operation of the open-to-atmosphere means and before a second predetermined time period elapses after the start of the operation of the open-to-atmosphere means.

To attain the object, according to a second aspect of the invention, there is provided an evaporative fuel-processing system for an internal combustion engine having an intake system, and a fuel tank, comprising:

an evaporative emission control system including a canister having an adsorbent accommodated therein, for adsorbing evaporative fuel generated in the fuel tank, and an air inlet port communicating with atmosphere, a charging passage extending between the canister and the fuel tank, a purging passage extending between the canister and the intake system, a purge control valve arranged across the purging passage, and a vent shut valve for opening and closing the air inlet port of the canister;

pressure-detecting means for detecting pressure within the evaporative emission control system;

open-to-atmosphere means for relieving the interior of the evaporative emission control system to the atmosphere, by closing the purging valve and opening the vent shut valve;

negatively pressurizing means for negatively pressurizing the interior of the evaporative emission control system into a predetermined negatively pressurized state, by opening the purge control valve and closing the vent shut valve;

leakage-checking means for closing the purge control valve after the interior of the evaporative emission control system is brought into the predetermined negatively pressurized state, and for determining whether there is leakage from the evaporative emission control system, based on a rate of decrease in negative pressure within the evaporative emission control system after the closing of the purge control valve;

tank state-detecting means for detecting a pressure state within the fuel tank, based on an output from the pressure-detecting means during operation of the open-to-atmosphere means; and operation-determining means for determining whether the negatively pressurizing means is to be operated, based on a result of the detection by the tank state-detecting means.

Preferably, in the second aspect of the invention, the evaporative emission control system further includes a charging valve arranged across the charging passage, the open-to-atmosphere means opening the charging valve during the operation of the open-to-atmosphere means.

Also preferably, the operation-determining means determines that the negatively pressurizing means is not to be operated, when the tank state-detecting means detects that the pressure within the fuel tank was positive at the start of the operation of the open-to-atmosphere means and at the same time an amount of change in pressure within the fuel tank after the start of the operation of the open-to-atmosphere means exceeds a predetermined value.

Preferably, in the second aspect of the invention, the tank state-detecting means calculates the amount of change in the pressure within the fuel tank after the start of operation of the open-to-atmosphere means, within a predetermined time period after a first predetermined time period elapses from the start of the operation of the open-to-atmosphere means and before a second predetermined time period elapses after the start of the operation of the open-to-atmosphere means.

The above and other objects, features, and advantages of the invention will be more apparent from the following detailed description taken in conjunction with the accompanying drawings.

BRIEF DESCRIPTION OF THE DRAWINGS

FIG. 3 is a program showing a subroutine for carrying out an open-to-atmosphere mode processing, which is executed at a step S3 in FIG. 2;

DETAILED DESCRIPTION

The invention will now be described in detail with reference to the drawings showing an embodiment thereof.

Figure 1:
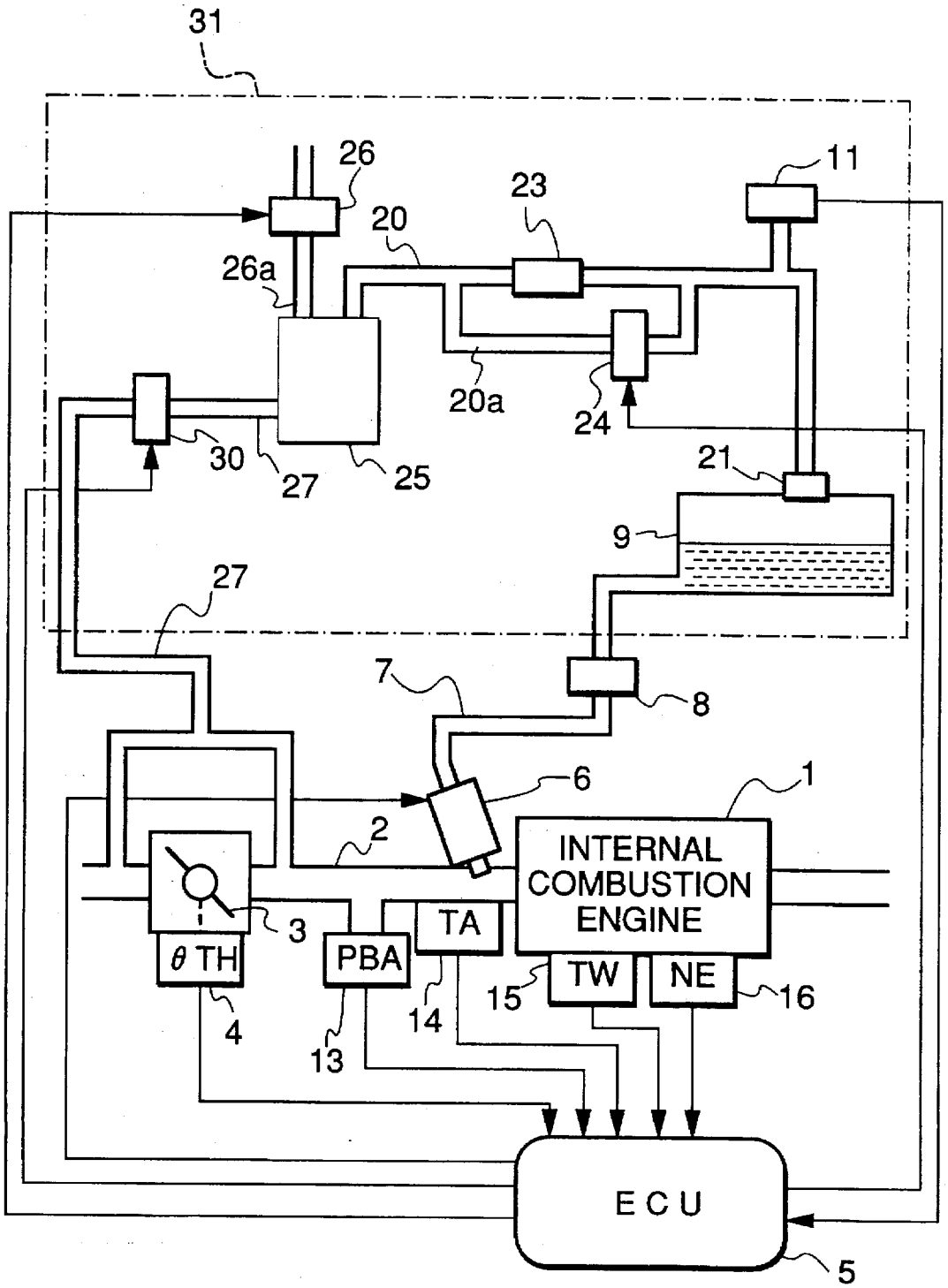
FIG. 1 is a block diagram schematically showing the whole arrangement of an internal combustion engine and an evaporative fuel-processing system therefor, according to an embodiment of the invention.

Referring first to FIG. 1, there is illustrated the whole arrangement of an internal combustion engine and an evaporative fuel-processing system therefor, according to an embodiment of the invention.

In the figure, reference numeral 1 designates an internal combustion engine (hereinafter simply referred to as "the engine") having four cylinders, not shown, for instance. Connected to the cylinder block of the engine 1 is an intake pipe 2, in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective intake valves, not shown. The fuel injection valves 6 are connected to a fuel tank 9 via a fuel supply pipe 7 and a fuel pump 8 arranged thereacross. The fuel injection valves 6 are electrically connected to the ECU 5 to have their valve opening periods controlled by signals therefrom.

An intake pipe absolute pressure (PBA) sensor 13 and an intake air temperature (TA) sensor 14 are inserted into the intake pipe 2 at locations downstream of the throttle valve 3. The PBA sensor 13 detects absolute pressure PBA within the intake pipe 2, and the TA sensor 14 detects intake air temperature TA. These sensors supply electric signals indicative of the respective sensed parameters to the ECU 5.

An engine coolant temperature (TW) sensor 15 formed of a thermistor or the like is inserted into a coolant passage formed in the cylinder block, which is full with an engine coolant, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The NE sensor 16 generates a signal pulse as a TDC signal pulse at each of predetermined crank angles whenever the crankshaft rotates through 180 degrees, the signal pulse being supplied to the ECU 5.

Next, an evaporative emission control system (hereinafter referred to as "the evaporative purging system") 31 will be described, which is comprised of the fuel tank 9, a charging passage 20, a canister 25, a purging passage 27, etc.

The fuel tank 9 is connected to the canister 25 via the charging passage 20 extending between the fuel tank 9 and the canister 25. A cut-off valve 21 is arranged at one end of the charging passage 20 connected to the fuel tank 9. The cut-off valve 21 is a float valve which closes when the fuel tank 9 is full or when it is sharply tilted. A pressure sensor 11 is inserted into the charging passage 20, for supplying a signal indicative of the sensed pressure within the charging passage 20 to the ECU 5.

Further arranged across the charging passage 20 is a two-way valve 23 which is constructed such that it opens when pressure PTANK within the fuel tank 9 (tank internal pressure) is higher than atmospheric pressure by approximately 10 mmHg or more or when the tank internal pressure PTANK is lower than pressure on one side of the two-way valve 23 toward the canister 25 by a predetermined amount or more.

Further connected to the charging passage 20 is a bypass passage 20*a* which bypasses the two-way valve 23. Arranged across the bypass passage 20*a* is a bypass valve (BPS; charging valve) 24 which is a normally-closed solenoid valve, and is opened and closed during execution of abnormality determination, described hereinafter, by a signal from the ECU 5.

The canister 25 contains activated carbon for adsorbing evaporative fuel, and has formed therein an air inlet port, not shown, which communicates with the atmosphere via a passage 26*a*. Arranged across the passage 26*a* is a vent shut valve (VSSV) 26, which is a normally-open solenoid valve, and is temporarily closed during execution of the abnormality determination, by a signal from the ECU 5.

The canister 25 is connected via the purging passage 27 to the intake pipe 2 at locations downstream and immediately upstream of the throttle valve 3. The purging passage 27 has a purge control valve (PCS) 30 arranged thereacross, which is a solenoid valve which is adapted to control the flow rate of a mixture of evaporative fuel and air as the on/off duty ratio of a control signal supplied to the valve from the ECU 5 is changed. Alternatively, the purge control valve 30 may be a linear solenoid valve whose valve lift can be linearly changed. If the alternative valve is used, a current signal indicative of the valve lift is supplied to the valve from the ECU 5 in place of the control signal indicative of the on/off duty ratio.

The ECU 5 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, bypass valve 24, vent shut valve 26, and purge control valve 30.

The CPU of the ECU 5 operates in response to the above-mentioned various engine parameter signals from the various sensors to control fuel injection periods of the fuel injection valves 6, and executes abnormality determination of the evaporative purging system 31 (determination as to leakage), based on a signal from the pressure sensor 11.

Figure 2:
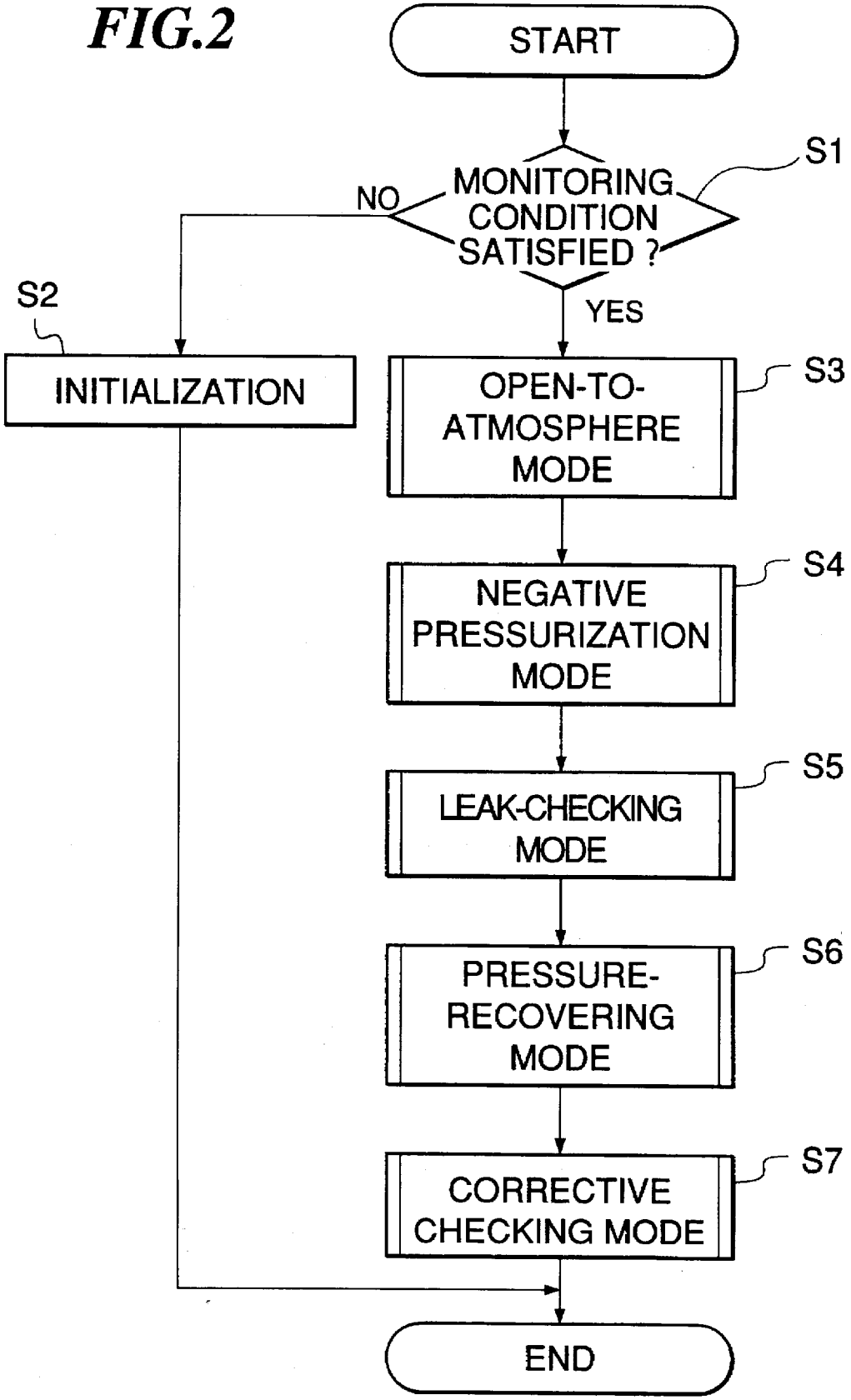
FIG. 2 is a flowchart showing a routine for carrying out a determination as to abnormality of an evaporative emission control system appearing in FIG. 1.

FIG. 2 shows a main routine for carrying out abnormality determination of the evaporative purging system 31, which is executed, for example, at predetermined time intervals.

First, at a step S1, it is determined whether or not monitoring conditions, i.e. conditions for permitting execution of abnormality determination are satisfied. The monitoring conditions are satisfied when the amount of evaporative fuel stored in the canister 25 is not large, and at the same time purging of evaporative fuel is being carried out at a sufficient rate so that the air-fuel ratio of an air-fuel fuel mixture supplied to the engine does not fluctuate even if the abnormality determination is executed. If the answer is negative (NO), initialization is executed at a step S2, followed by terminating the present routine. The initialization is carried out such that an up-counting timer T to be used for processings described hereinafter is reset to "0", and an output value from the pressure sensor 11 (hereinafter referred to as "the tank internal pressure PTANK") generated at this time is stored as an initial pressure PINI. At the same time, if conditions for carrying out purging are then satisfied, normal purging is carried out by closing the bypass valve 24, opening the vent shut valve 26, and controlling the purge control valve 30, based on the duty ratio.

If the monitoring conditions are satisfied at the step S1, an open-to-atmosphere mode processing (at a step S3), a negative pressurization mode processing (at a step S4), a leak-checking mode processing (at a step S5), a pressure-recovering mode processing (at a step S6), and a corrective checking mode processing(at a step S7) are sequentially executed, followed by terminating the abnormality determination.

Figure 9:
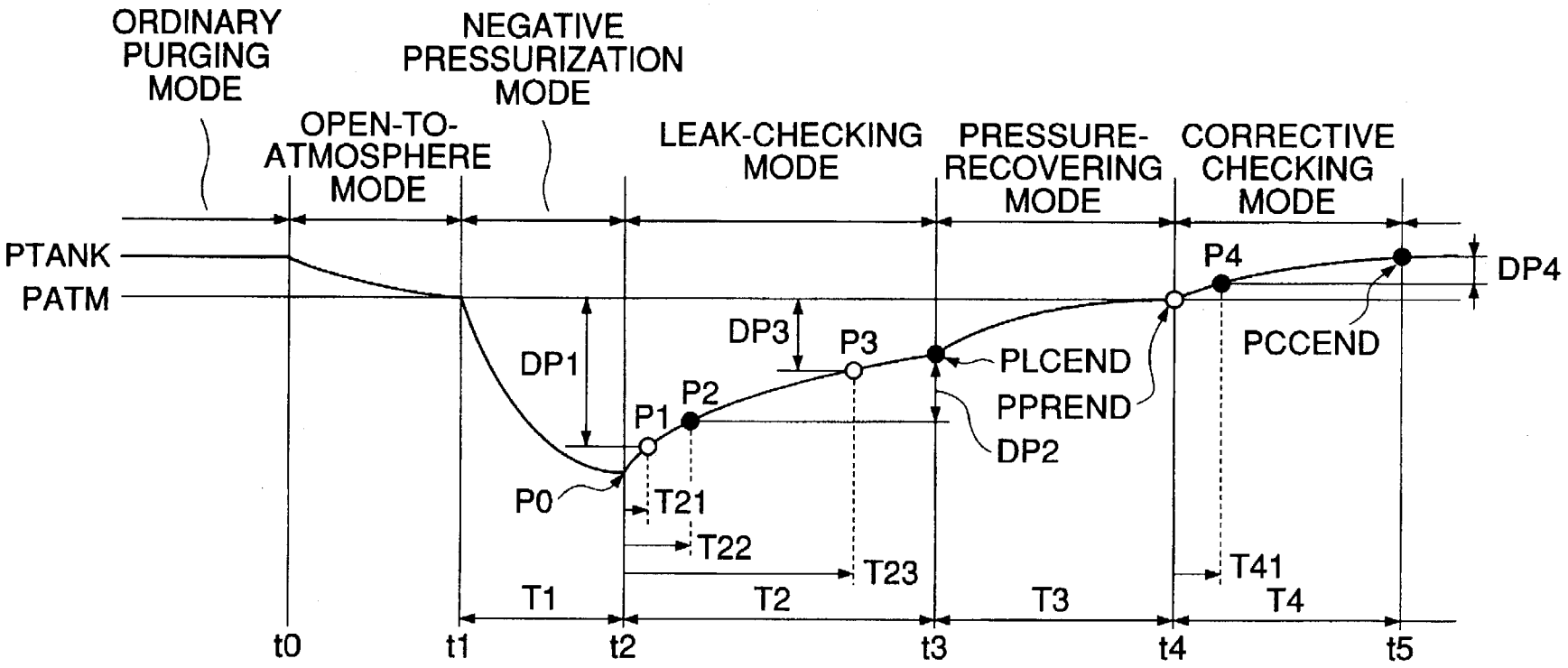
FIG. 9 is a timing chart showing changes in the tank internal pressure PTANK with the lapse of time.

FIG. 3 shows a subroutine for carrying out the open-to-atmosphere mode processing executed at the step S3 in FIG. 2 (corresponding to a time point t0 to a time point t1 in FIG. 9).

First, at a step S9, the open-to-atmosphere mode is set by opening the bypass valve 24 and the vent shut valve 26, and closing the purge control valve 30. Then, it is determined at a step S10 whether or not the value of the timer T is larger than a first predetermined time period TS and at the same time smaller than a second predetermined time period TE. In the first loop of execution of the step S10, T<TS holds, and then the program proceeds to a step S11, wherein it is determined whether or not the value of the timer T is smaller than the first predetermined time period TS. In the first loop of execution of the step S11, the answer is affirmative (YES), and then the program is immediately terminated. The first and second predetermined time periods TS and TE satisfy the relationship of TS<TE<T0 (where T0 represents a predetermined open-to-atmosphere time period, referred to hereinafter).

Thereafter, when the first predetermined time period TS has elapsed but the second predetermined time period TE has not elapsed, the program proceeds to a step S12, wherein a difference DP0 (=PTANK–PINI, hereinafter referred to as "the initial change rate") between a present value of the tank internal pressure PTANK and the initial pressure PINI read in by the initialization executed at the step S2 in FIG. 2 is calculated. Then, it is determined at a step S13 whether or not the initial change rate DP0 is positive. If DP0<0 holds, which means that the tank internal pressure PTANK has been or being is reduced, it is determined at a step S16 whether or not the absolute value |DP0| of the initial change rate DP0 is larger than a positive predetermined value DPP.

Figure 4B:
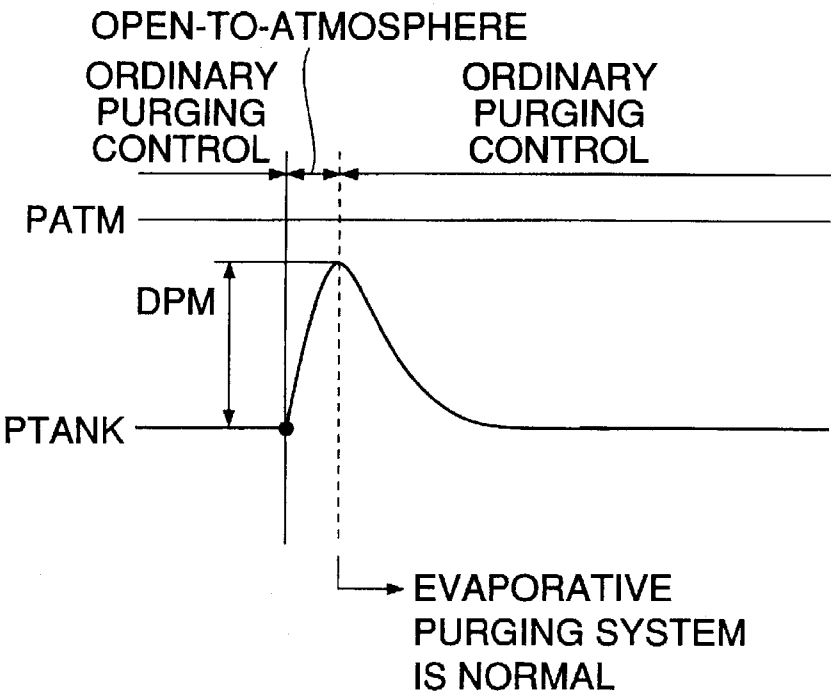
FIG. 4B is a graph useful in explaining a case where the evaporative emission control system is determined to be normal during execution of the open-to-atmosphere mode processing.
Figure 4A:
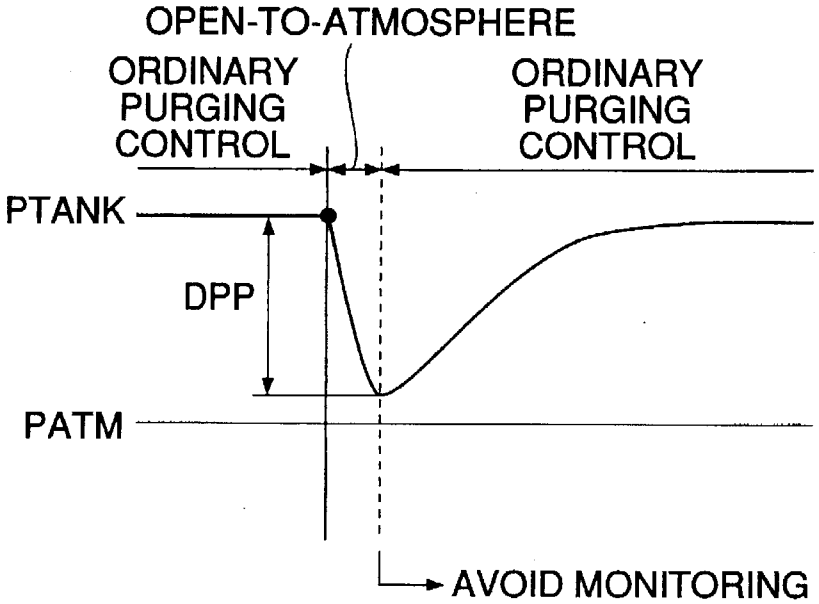
FIG. 4A is a graph useful in explaining a case where the abnormality determination is immediately terminated during execution of the open-to-atmosphere mode processing due to generation of a large amount of evaporative fuel.

If |DP0|≦DPP holds, which means that the initial pressure PINI is so high that the absolute value of the initial change rate DP0 exceeds the positive predetermined value DPP before the tank internal pressure PTANK reaches the atmospheric pressure, as shown in FIG. 4A, it is presumed that a large amount of evaporative fuel is generated in the fuel tank 9. Therefore, the abnormality determination is immediately terminated, that is, the abnormality determination is suspended in order to prevent a misjudgment at a step S17. On the other hand, if |DP0|<DPP holds at the step S16, the program is immediately terminated.

If DP0>0 holds at the step S13, it is determined at a step S14 whether or not the DP0 value is larger than a negative predetermined value DPM. If DP0≧DPM holds, which means that the initial pressure PINI is negative and the initial change rate DP0 exceeds the negative predetermined value DPM before the tank internal pressure PTANK reaches the atmospheric pressure, as shown in FIG. 4B. Therefore, it is presumed that the tank internal pressure PTANK had been held negative before the open-to-atmosphere mode processing was started, so that it is determined at a step S15 that the evaporative purging system 31 is normal, followed by terminating the abnormality determination at the step S17. By virtue of this processing, a time period required for the abnormality determination can be largely shortened. Further, if DP0<DPM holds at the step S14, the program is immediately terminated.

By executing the steps S12 to S17, if the initial pressure PINI is negative and at the same time the initial change rate DP0 exceeds the negative predetermined value DPM, the evaporative purging system is determined to be normal. Further, if the initial pressure PINI is positive and at the same time the absolute value of the initial change rate DP0 exceeds the positive predetermined value DPP, the abnormality determination is suspended, immediately followed by terminating the abnormality determination. As a result, the time period required for the abnormality determination can be largely shortened. When the abnormality determination is suspended, ordinary purging control is carried out depending on operating conditions of the engine.

If the answer to the question of the step S10 becomes negative (NO), i.e. if the second predetermined time period TE has elapsed from the start of this processing, the answer to the question of the step S11 also becomes negative NO), and then the program proceeds to a step S18.

At the step S18, it is determined whether or not the value of the timer T exceeds the predetermined open-to-atmosphere time period T0. In the first loop of execution of the step S18, T<T0 holds, and therefore the program proceeds to a step S19, wherein it is determined whether or not the tank internal pressure PTANK is lower than atmospheric pressure PATM. If DP0<0 holds and at the same time the initial value PINI assumes a positive value, the answer is negative (NO), and then the program is immediately terminated. If the predetermined open-to-atmosphere time period T0 has elapsed, the program proceeds from the step S18 to a step S20, wherein a negative pressurization mode permission flag FEVP1, which, when set to "1", indicates that execution of the negative pressurization mode is permitted, is set to "1" and at the same time the timer T is reset to "0", followed by terminating the present routine.

On the other hand, if DP0>0 holds and at the same time the initial pressure PINI assumes a negative value, PTANK<PATM holds at the step S19 even if the predetermined open-to-atmosphere time period T0 has not elapsed. Therefore, the step S20 is executed, followed by terminating the present routine.

By executing the above processing, when the initial pressure PINI assumes a positive value, the tank internal pressure PTANK drops to a value almost equal to the atmospheric pressure PATM (corresponding to the time point t1 in FIG. 9).

Figure 5:
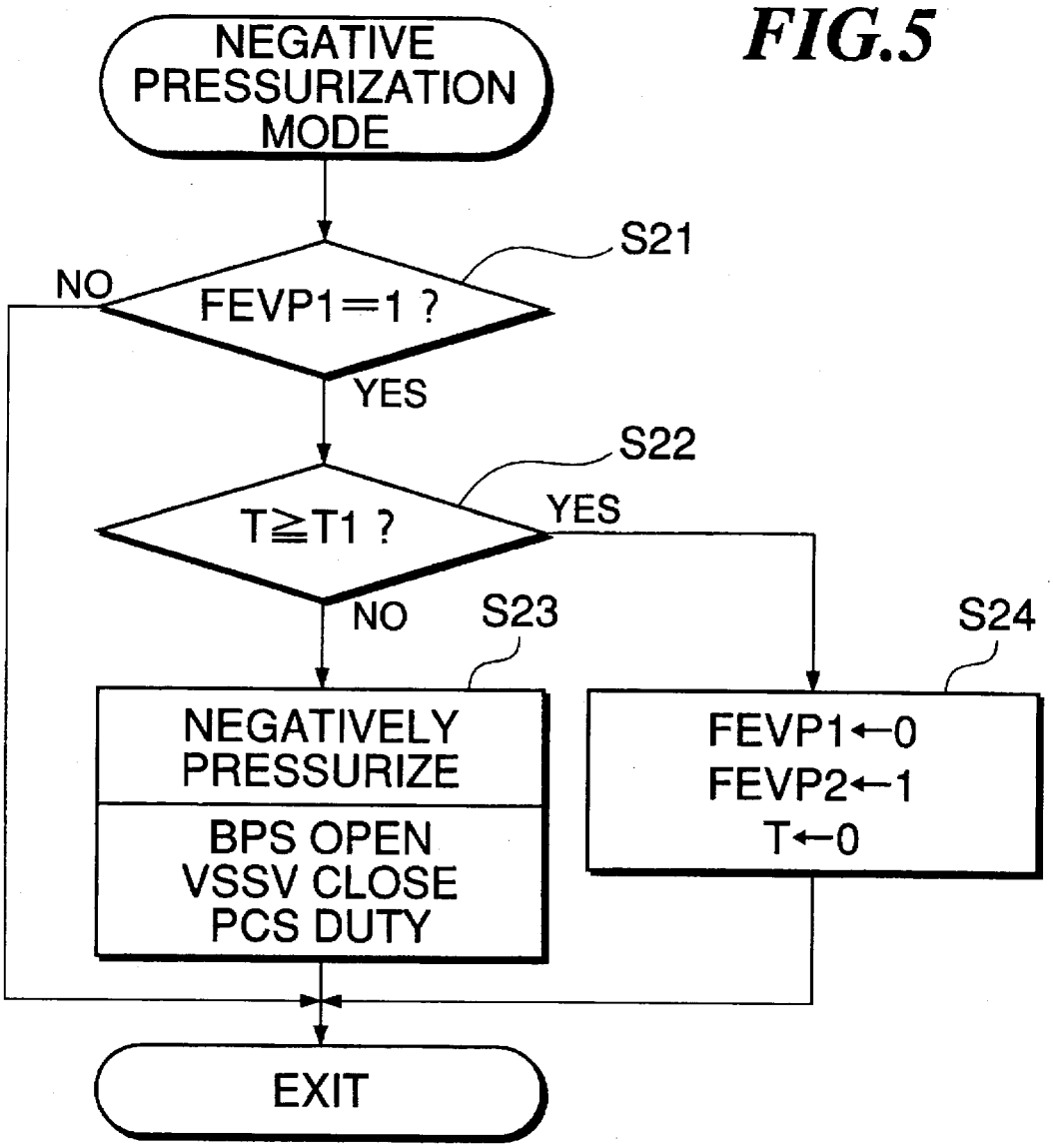
FIG. 5 is a flowchart showing a subroutine for carrying out a negative pressurization mode processing, which is executed at a step S4 in FIG. 2.

FIG. 5 shows a subroutine for carrying out the negative pressurization mode processing executed at the step S4 in FIG. 2 (corresponding to the time point t1 to a time point t2 in FIG. 9).

First, at a step S21, it is determined whether or not the negative pressurization mode permission flag FEVP1 has been set to "1". If FEVP1=0 holds, which means that execution of the negative pressurization mode is not permitted, the program is immediately terminated.

On the other hand, if FEVP1=1 holds at the step S21, it is determined at a step S22 whether or not the value of the timer T exceeds a predetermined negative pressurization time period T1. In the first loop of execution of the step S22, T<T1 holds, and therefore the negative pressurization mode is set by opening the bypass valve 24, closing the vent shut valve 26, and controlling the purge control valve 30, based on the duty ratio, followed by terminating the present routine. The duty control of the purge control valve 30 is carried out in the following manner: A desired flow rate table, not shown, stored beforehand in the memory means of the ECU 5 is retrieved to determine a desired purge flow rate QEVAP according to the tank internal pressure PTANK. The control duty ratio is determined according to the thus determined QEVAP value. The desired flow rate table is set such that the QEVAP value increases as the PTANK value increases.

When the predetermined negative pressurization time period T1 has elapsed, i.e. when T=T1 holds (the time point t2 in FIG. 9), the program proceeds to a step S24, wherein the negative pressurization mode permission flag FEVP1 is set to "0", and a leak-checking mode permission flag FEVP2, which, when set to "1", indicates that execution of the leak-checking mode is permitted, is set to "1" and at the same time the timer T is reset to "0", followed by terminating the present routine.

By executing the above processing, the negative pressure within the intake pipe 2 of the engine is introduced into the evaporative purging system 31, whereby the tank internal pressure PTANK drops to a value P0.

Figure 6:
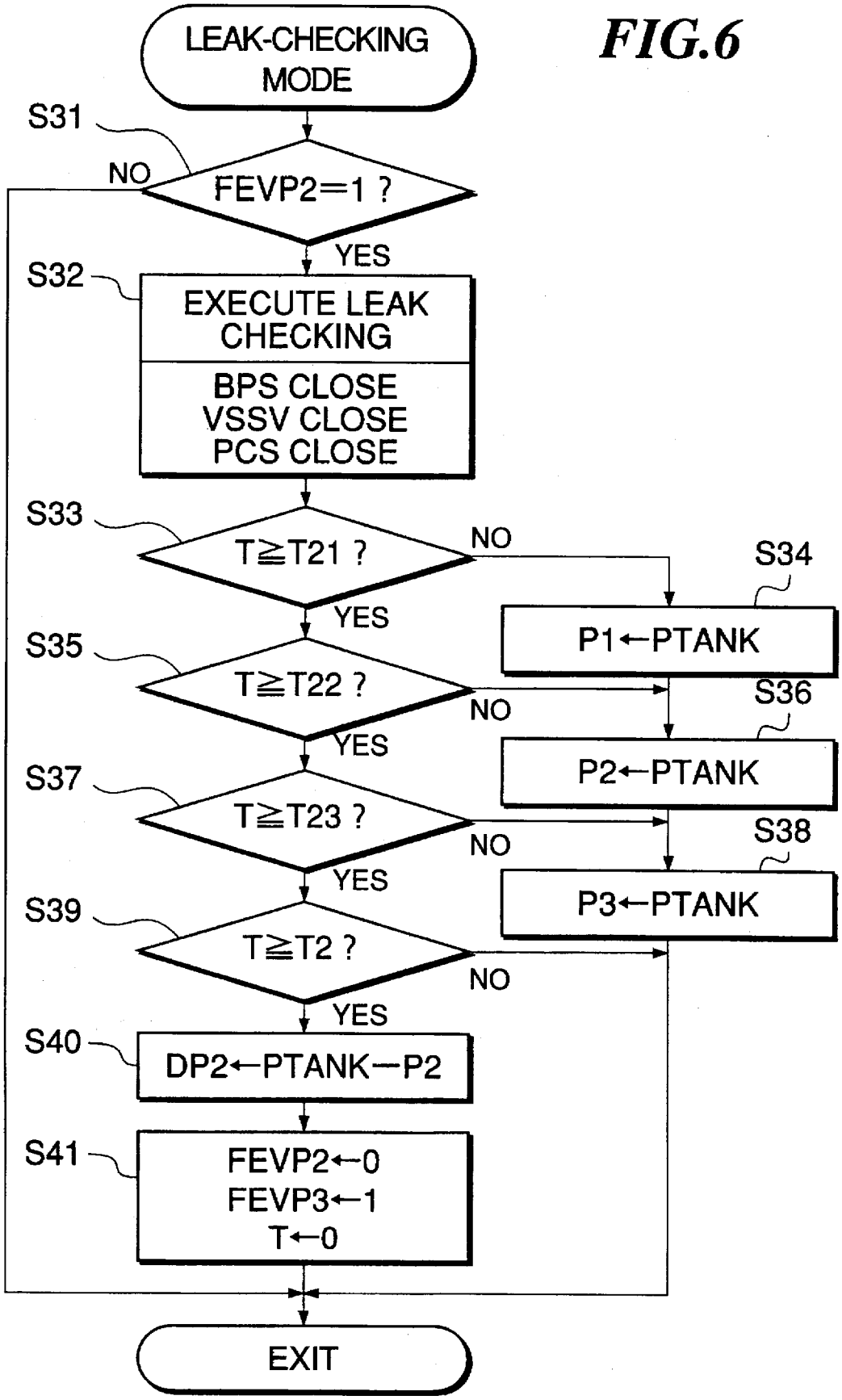
FIG. 6 is a flowchart showing a subroutine for carrying out a leak-checking mode processing, which is executed at a step S5 in FIG. 2.

FIG. 6 shows a subroutine for carrying out the leak-checking mode processing executed at the step S5 in FIG. 2 (corresponding to the time point t2 to a time point t3 in FIG. 9).

First, at a step S31, it is determined whether or not the leak-checking mode permission flag FEVP2 has been set to "1". If FEVP2=0 holds, i.e. if execution of the leak-checking mode is not permitted, the program is immediately terminated.

On the other hand, if FEVP2=1 holds, i.e. if execution of the leak-checking mode is permitted, the bypass valve 24, the vent shut valve 26, and the purge control valve 30 are all closed to execute the leak-checking mode at a step S32. At the following step S33, it is determined whether or not the value of the timer T exceeds a first predetermined time period T21. In the first loop of execution of the step S33, T<T21 holds, and then a present value of the tank internal pressure PTANK is set to a first detected pressure P1, a second detected pressure P2, and a third detected pressure P3, at respective steps S34, S36, and S38, followed by terminating the present routine.

When the first predetermined time period T21 has elapsed, the program proceeds from the step S33 to a step S35, wherein it is determined whether or not the value of the timer T exceeds a second predetermined time period T22. In the first loop of execution of the step S35, T<T22 holds, and then the second detected value P2 and the third detected value P3 are updated to a present value of the tank internal pressure PTANK at the respective steps S36 and S38, followed by terminating the present routine.

When the second predetermined time period T22 has elapsed, the program proceeds from the step S35 to a step S37, wherein it is determined whether or not the value of the timer T exceeds a third predetermined time period T23. In the first loop of execution of the step S37, T<T23 holds, and then the third detected value P3 is updated to a present value of the tank internal pressure PTANK at the step S38, followed by terminating the present routine.

When the third predetermined time period T23 has elapsed, the program proceeds from the step S37 to a step S39, wherein it is determined whether or not the value of the timer T exceeds a predetermined leak-checking time period T2. In the first loop of execution of the step S39, T<T2 holds, and then the program is immediately terminated.

By executing the step S33 to the step S38, as shown in FIG. 9, the tank internal pressure PTANK detected when the first predetermined time period T21 elapses from the leak-checking mode starting time point t2 is set to the first detected pressure P1, the tank internal pressure PTANK detected when the second predetermined time period T22 elapses from the time point t2 is set to the second detected pressure P2, and the tank internal pressure PTANK detected when the third predetermined time period T23 elapses from the time point t2 is set to the third detected pressure P3, respectively.

When the predetermined leak-checking time period T2 has elapsed from the time pint t2, the program proceeds from the step S39 to a step S40, wherein a pressure difference DP2 (=PLCEND–P2, hereinafter referred to as "the second pressure difference") between a present value of the tank internal pressure PTANK (tank internal pressure PLCEND assumed at the time point t3 in FIG. 9) and the second detected pressure P2 is calculated. Then, at a step S41, the leak-checking mode permission flag FEVP2 is set to "0", a pressure-recovering mode permission flag FEVP3, which, when set to "1", indicates that execution of the pressure recovering-mode is permitted, is set to "1", and the timer T is reset to "0", followed by terminating the present routine.

Figure 7:
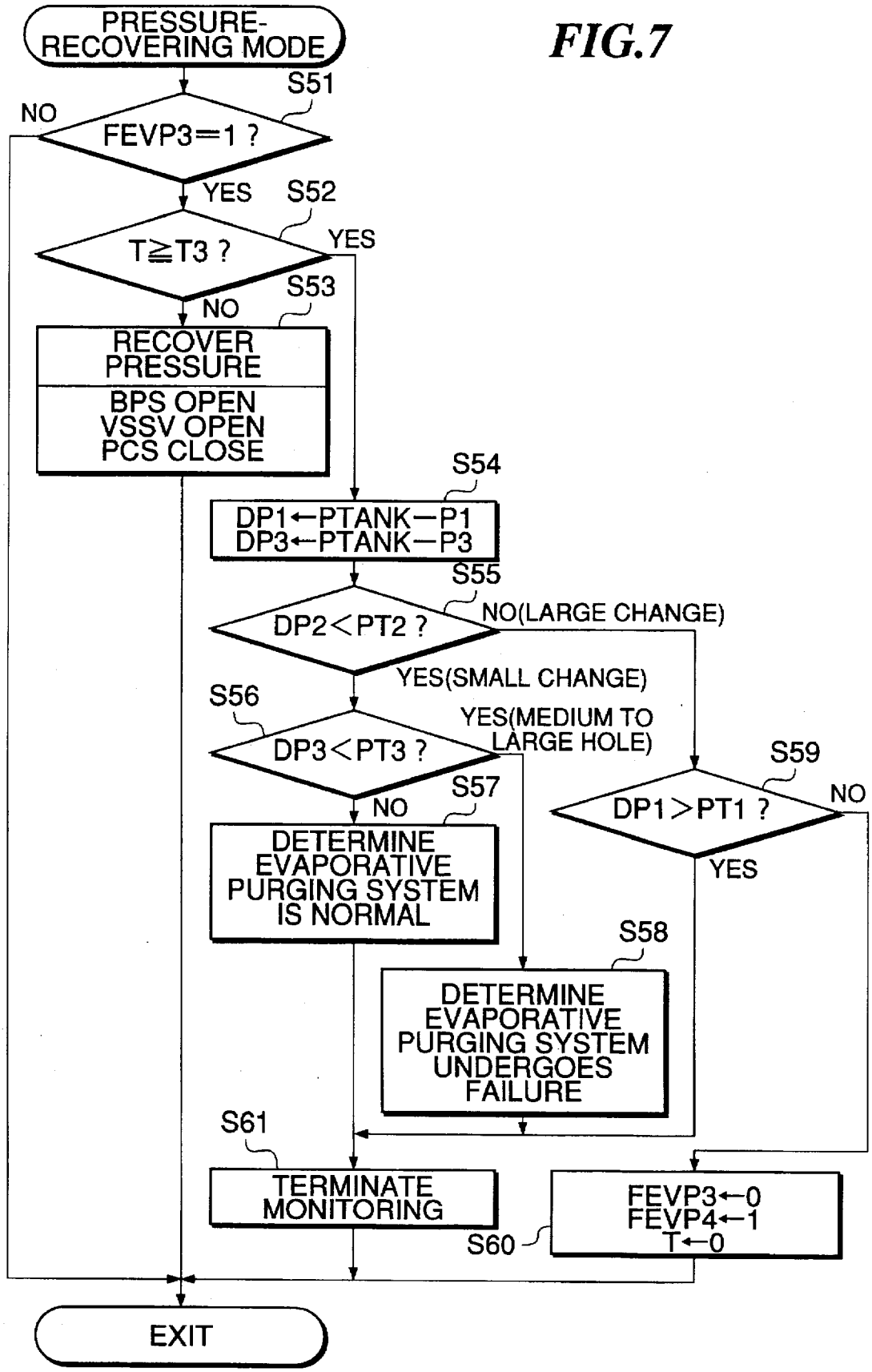
FIG. 7 is a flowchart showing a subroutine for carrying out a pressure-recovering mode processing, which is executed at a step S6 in FIG. 2.

FIG. 7 shows a subroutine for carrying out the pressure-recovering mode processing executed at the step S6 in FIG. 2 (corresponding to the time point t3 to a time point t4 in FIG. 9).

First, at a step S51, it is determined whether or not the pressure-recovering mode permission flag FEVP3 has been set to "1". If FEVP3=0 holds, i.e. if execution of the pressure-recovering mode is not permitted, the program is immediately terminated.

On the other hand, if FEVP3=1 holds at a step S51, it is determined at a step S52 whether or not the value of the timer T exceeds a predetermined pressure-recovering time period T3. In the first loop of execution of the step S52, T<T3 holds, and then the program proceeds to a step S53, wherein the pressure-recovering mode is set by opening the bypass valve 24 and the vent shut valve 26, and closing the purge control valve 30 (the same valve states as in the open-to-atmosphere mode), followed by terminating the present routine.

If the predetermined pressure-recovering time period T3 has elapsed, the program proceeds from the step S52 to a step S54, wherein calculations are made of a pressure difference DP1 (=PPREND–P1, hereinafter referred to as "the first pressure difference") between a present value of the tank internal pressure PTANK (tank internal pressure PPREND assumed when the pressure-recovering mode is terminated at the time point t4 in FIG. 9) and the first detected pressure P1, and a pressure difference DP3 (=PPREND–P3, hereinafter referred to as "the third pressure difference") between the value PPREND and the third detected pressure P3. Further, it is determined at a step S55 whether or not the second pressure difference DP2 is smaller than a second threshold value PT2.

If DP2<PT2 holds at the step S55, which means that a change in pressure during the leak-checking mode is small, it is determined that the evaporative purging system 31 is normal or it has a medium-sized hole or a large-sized hole formed therein. Then, it is determined at a step S56 whether or not the third pressure difference DP3 is smaller than a third threshold value PT3. If DP3≧PT3 holds, which means that the third detected pressure P3 is lower than the tank internal pressure PPREND (almost equal to the atmospheric pressure PATM) at the time point t4 by a predetermined amount or more. Therefore, it is determined at a step S57 that the evaporative purging system 31 is normal, and then the abnormality-determination is terminated at a step S61 without executing a processing of FIG. 8, hereinafter described.

On the other hand, if DP3<TP3 holds at the step S56, which means that the third detected pressure P3 is almost equal to the atmospheric pressure PATM, it is determined at a step S58 that a large-sized hole or a medium-sized hole is present in the evaporative purging system 31. Therefore, the program is terminated at the step S61 without executing the processing of FIG. 8.

On the other hand, if DP2≧PT2 holds at the step S55, which means that the change in pressure during the leak-checking mode is large, it is determined that the cut-off valve 21 is closed (i.e. the fuel tank 9 is full), or the evaporative purging system 31 is normal and at the same time evaporative fuel is generated in the fuel tank 9 in an extremely large amount, or a small hole is present in the system 31. Then, it is determined at a step S59 whether or not the first pressure difference DP1 is larger than the first threshold value PT1. If DP1>TP1 holds, which means that the first detected pressure DP1 is low, it is determined that the fuel tank 9 is full to close the cut-off valve 21. Therefore, the determination as to abnormality is suspended, and the abnormality determination is terminated at the step S61 without executing the processing of FIG. 8.

If DP1≦PT1 holds at the step S59, it is determined that the system 31 is normal or has a small hole formed therein. Then, at a step S60, the pressure-recovering mode permission flag FEVP3 is set to "0", a corrective checking mode permission flag FEVP4, which, when set to "1", indicates that execution of the corrective checking mode is permitted, is set to "1", and the timer T is reset to "0", followed by terminating the present routine.

Figure 8:
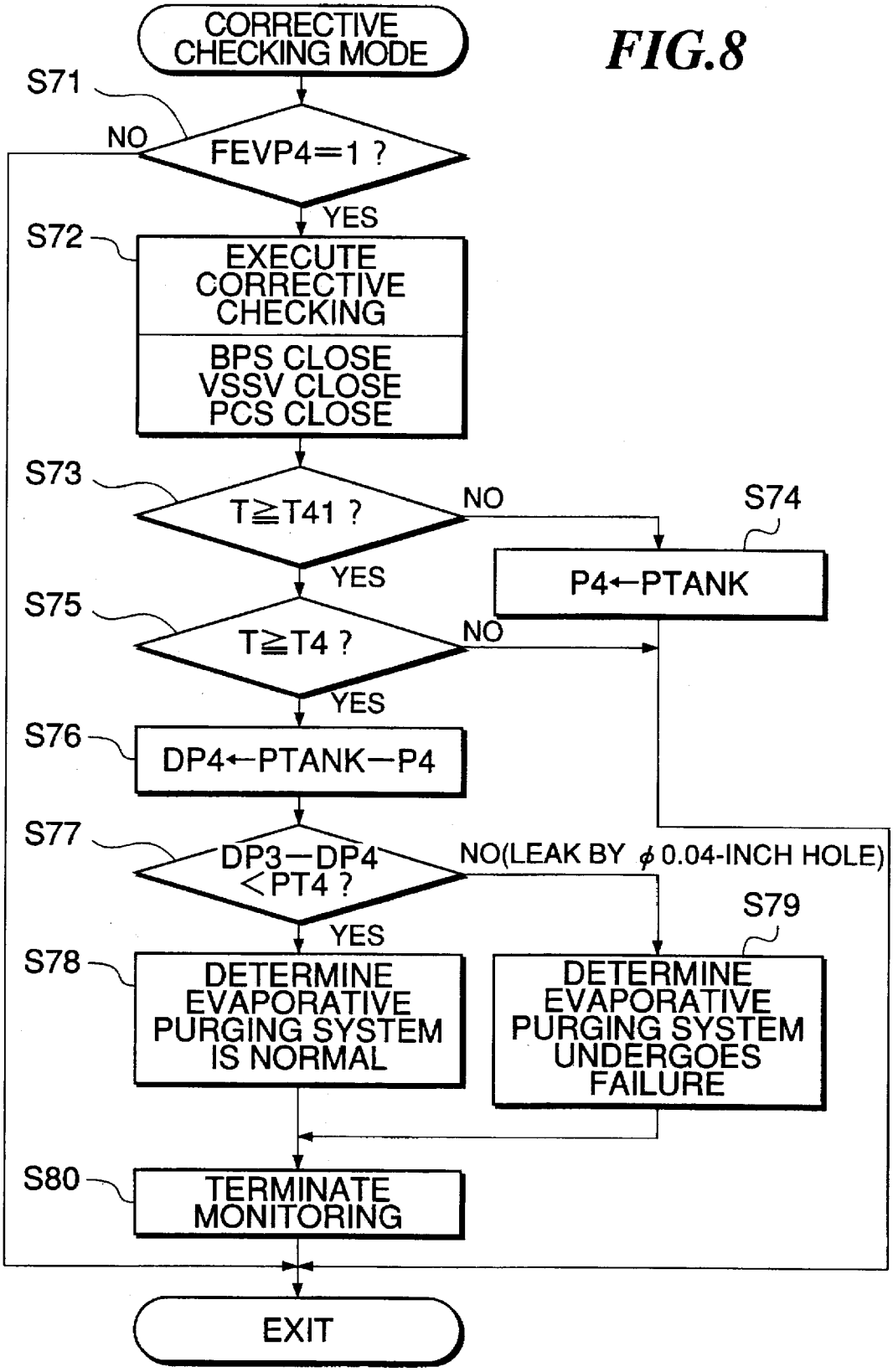
FIG. 8 is a flowchart showing a subroutine for carrying out a corrective checking mode processing, which is executed at a step S7 in FIG. 2.

FIG. 8 shows a subroutine for carrying out the corrective checking mode processing executed at the step S7 in FIG. 2 (corresponding to the time point t4 to a time point t5 in FIG. 9).

First, at a step S71, it is determined whether or not the corrective checking mode permission flag FEVP4 assumes "1". If FEVP4=0 holds, i.e. if execution of the corrective checking mode processing is not permitted, the program is immediately terminated.

If FEVP4=1 holds at the step S710 the program proceeds to a step S72, wherein the bypass valve 24, the vent shut valve 26 and the purge control valve 30 are all closed, similarly to the leak-checking mode, to thereby execute the corrective checking mode processing. Then, it is determined at a step S73 whether or not the value of the timer T exceeds a predetermined delay time T41. In the first loop of execution of the step S73, T<T41 holds, and then the program proceeds to a step S74, wherein a present value of the tank internal pressure PTANK is set to a fourth detected pressure P4, followed by terminating the present routine.

After the predetermined delay time T41 has elapsed, the program proceeds from the step S73 to a step S75, and therefore the fourth detected pressure P4 is updated to a value of the tank internal pressure PTANK assumed when the predetermined delay time T41 has elapsed from the corrective checking mode starting time point t4.

At the step S75, it is determined whether or not the value of the timer T exceeds a predetermined corrective checking time period T4. In the first loop of execution of the step S75, T<T4 holds, and then the present program is immediately terminated. If T=T4 holds, the program proceeds from the step S75 to a step S76.

At the step S76, a pressure difference DP4 (=PCCEND–P4, hereinafter referred to as "the fourth pressure difference") between a present value of the tank internal pressure PTANK (tank internal pressure PCCEND assumed at the time point t5 in FIG. 9) and the fourth detected pressure P4 is calculated. Then, it is determined at a step S77 whether or not a difference (=DP3–DP4) between the third pressure difference DP3 and the fourth pressure difference DP4 is smaller than a fourth threshold value PT4.

If (DP3–DP4)<PT4 holds, which means that the difference between the third pressure difference DP3 and the fourth pressure difference DP4 is small, it is determined at a step S78 that the large change in pressure (second pressure difference DP2) during the leak-checking mode was caused by generation of a large amount of evaporative fuel and hence the evaporative purging system 31 is normal, followed by terminating the abnormality determination at a step S80.

On the other hand, if (DP3–DP4)≧PT4 holds, it is determined at a step S79 that the large change in pressure (second pressure difference DP2) during the leak-checking mode was caused by a small hole (e.g. a hole with a diameter of approximately 0.04 inches) present in the evaporative purging system 31, followed by terminating the abnormality determination at the step S80.

As described hereinabove, according to the present embodiment, in addition to the detected pressures P2 and PLCEND (see FIG. 9) which have been used in the prior art abnormality determination, the detected pressures P1 and P3 are employed in the abnormality determination. As a result, even if a large hole is present in the system 31, or the fuel tank 9 is full (the cut-off valve 21 is closed), these states can be precisely discriminated without error, whereby the determination as to presence/absence of leakage can be accurately carried out. Further, the detected pressures P1 and P3 per se are not applied in carrying out the determination, but the pressure differences DP1 and DP3 between the detected pressure PPREND assumed at the termination of the pressure-recovering mode and the respective detected pressures P1 and P3 are applied. As a result, even if a deviation in the output value from the pressure sensor 11 occurs due to aging or the like, accurate abnormality determination can be ensured.

A summary of the above described manners of the abnormality determination according to the present embodiment are shown in a table below:

TABLE

| | REFERENCE VALUES (RLT) | | | |
|---|---|---|---|---|
| THRESHOLD VALUES (LMT) | DP2 PT2 | DP3 PT3 | DP1 PT1 | DP3–DP4 PT4 |
| (1) NORMAL | RLT<LMT | RLT>LMT | | |
| | RLT>LMT | | RLT<LMT | RLT<LMT |
| (2) ϕ0.04 INCH LEAK | RLT>LMT | | RLT<LMT | RLT>LMT |
| (3) LARGE HOLE | RLT<LMT | RLT<LMT | | |
| (4) FUEL TANK IS FILLED | RLT>LMT | | RLT>LMT | |

Symbols in the top row in the table indicate kinds of reference values RLT, i.e. parameters employed for the abnormality determination, and symbols in the second row indicate kinds of threshold values LMT employed for the abnormality determination. Symbols in the third row et seq. indicate conditions which satisfy respective cases, i.e. (1) where the evaporative purging system 31 is normal, (2) where the system 31 has a small hole (with a diameter of approximately 0.04 inches), (3) where the system 31 has a large (or medium) hole, and where the fuel tank is full (the cut-off valve 21 is closed).

More specifically, if the second pressure difference DP2 is smaller than the second threshold value PT2 and at the same time the third pressure difference DP3 is larger than the third threshold value PT3 (steps S55→S56→S57 in FIG. 7), or if the second pressure difference DP2 is larger than the second threshold value PT2, at the same time the first pressure difference DP1 is smaller than the first threshold value PT1, and at the same time the difference (DP3–DP4) between the third pressure difference and the fourth difference is smaller than the fourth threshold value PT4 (steps S55→S59→S60 in FIG. 7 and steps S77→S78 in FIG. 8), the evaporative purging system 31 is determined to be normal.

If the second pressure difference DP2 is larger than the second threshold value PT2, at the same time the first pressure difference DP1 is smaller than the first threshold value PT1, and at the same time the difference (DP3–DP4) between the third pressure difference and the fourth pressure difference is larger than the fourth threshold value PT4 (steps S55→S59→S60 in FIG. 7 and steps S77→S79 in FIG. 8), the evaporative purging system 31 is determined to have a small hole formed therein.

Further, if the second pressure difference DP2 is smaller than the second threshold value PT2 and at the same time the third pressure difference DP3 is smaller than the third threshold value PT3 (steps S55→S56→S58 in FIG. 7), the evaporative purging system 31 is determined to have a large hole formed therein.

Still further, if the second pressure difference DP2 is larger than the second threshold value PT2 and at the same time the first pressure difference DP1 is larger than the first threshold value PT1 (steps S55→S56→S61 in FIG. 7), the fuel tank 9 is determined to be full.

Although in the above described embodiment the pressure sensor 11 is inserted into the charging passage 20 at a location shown in FIG. 1, this is not limitative. Alternatively, it may be directly arranged in the fuel tank 9 or arranged in the charging passage 20 at a location intermediate between the canister 25 and the two-way valve 23.

What is claimed is:

1. An evaporative fuel-processing system for an internal combustion engine having an intake system, and a fuel tank, comprising:

an evaporative emission control system including a canister having an adsorbent accommodated therein, for adsorbing evaporative fuel generated in said fuel tank, and an air inlet port communicating with atmosphere, a charging passage extending between said canister and said fuel tank, a purging passage extending between said canister and said intake system, a purge control valve arranged across said purging passage, and a vent shut valve for opening and closing said air inlet port of said canister;

pressure-detecting means for detecting pressure within said evaporative emission control system;

open-to-atmosphere means for relieving said interior of said evaporative emission control system to said atmosphere, by closing said purging valve and opening said vent shut valve;

tank state-detecting means for detecting a pressure state within said fuel tank, based on an output from said pressure-detecting means during operation of said open-to-atmosphere means; and determining means for determining whether said evaporative emission control system is normal, based on a result of the detection by said tank state-detecting means.

2. An evaporative fuel-processing means as claimed in claim 1, wherein said evaporative emission control system further includes a charging valve arranged across said charging passage, said open-to-atmosphere means opening said charging valve during the operation of said open-to-atmosphere means.

3. An evaporative fuel-processing system as claimed in claim 1, wherein said determining means determines that said evaporative emission control system is normal, when said tank state-detecting means detects that pressure within said fuel tank was negative at the start of the operation of said open-to-atmosphere means and at the same time an amount of change in said pressure within said fuel tank after the start of the operation of said open-to-atmosphere means exceeds a predetermined value.

4. An evaporative fuel-processing system as claimed in claim 1, including:

negatively pressurizing means for negatively pressurizing said interior of said evaporative emission control system into a predetermined negatively pressurized state, by opening said purge control valve and closing said vent shut valve; and leakage-checking means for closing said purge control valve after said interior of said evaporative emission control system is brought into said predetermined negatively pressurized state, and for determining whether there is leakage from said evaporative emission control system, based on a rate of decrease in negative pressure within said evaporative emission control system after the closing of said purge control valve; and wherein said negatively pressurizing means is operated when said determining means does not determine that said evaporative emission control system is normal.

5. An evaporative fuel-processing system as claimed in claim 3, wherein said tank state-detecting means calculates said amount of change in said pressure within said fuel tank after the start of operation of said open-to-atmosphere means, within a predetermined time period after a first predetermined time period elapses from the start of the operation of said open-to-atmosphere means and before a second predetermined time period elapses after the start of the operation of said open-to-atmosphere means.

6. An evaporative fuel-processing system for an internal combustion engine having an intake system, and a fuel tank, comprising:

an evaporative emission control system including a canister having an adsorbent accommodated therein, for adsorbing evaporative fuel generated in said fuel tank, and an air inlet port communicating with atmosphere, a charging passage extending between said canister and said fuel tank, a purging passage extending between said canister and said intake system, a purge control valve arranged across said purging passage, and a vent shut valve for opening and closing said air inlet port of said canister;

pressure-detecting means for detecting pressure within said evaporative emission control system;

open-to-atmosphere means for relieving said interior of said evaporative emission control system to said atmosphere, by closing said purging valve and opening said vent shut valve;

negatively pressurizing means for negatively pressurizing said interior of said evaporative emission control system into a predetermined negatively pressurized state, by opening said purge control valve and closing said vent shut valve;

leakage-checking means for closing said purge control valve after said interior of said evaporative emission control system is brought into said predetermined negatively pressurized state, and for determining whether there is leakage from said evaporative emission control system, based on a rate of decrease in negative pressure within said evaporative emission control system after the closing of said purge control valve;

tank state-detecting means for detecting a pressure state within said fuel tank, based on an output from said pressure-detecting means during operation of said open-to-atmosphere means; and operation-determining means for determining whether said negatively pressurizing means is to be operated, based on a result of the detection by said tank state-detecting means, wherein said operation-determining means determines that said negatively pressurizing means is not to be operated, when said tank state-detecting means detects that said pressure within said fuel tank was positive at the start of the operation of said open-to-atmosphere means and at the same time an amount of change in pressure within said fuel tank after the start of the operation of said open-to-atmosphere means exceeds a predetermined value.

7. An evaporative fuel-processing means as claimed in claim 6, wherein said evaporative emission control system further includes a charging valve arranged across said charging passage, said open-to-atmosphere means opening said charging valve during the operation of said open-to-atmosphere means.

8. An evaporative fuel-processing system as claimed in claim 6, wherein said tank state-detecting means calculates said amount of change in said pressure within said fuel tank after the start of operation of said open-to-atmosphere means, within a predetermined time period after a first predetermined time period elapses from the start of the operation of said open-to-atmosphere means and before a second predetermined time period elapses after the start of the operation of said open-to-atmosphere means.

* * * * *